US005285989A

United States Patent [19]

Zilbert et al.

[11] Patent Number: 5,285,989

[45] Date of Patent: Feb. 15, 1994

[54] INDUSTRIAL DRUM DISPENSING STAND WITH DRIP CATCH BASIN

[75] Inventors: Seymour Zilbert, Demarest, N.J.; Peter G. Hamaker, Beaufort, S.C.

[73] Assignee: Bergen Barrel & Drum Co., Kearny, N.J.

[21] Appl. No.: 948,223

[22] Filed: Sep. 21, 1992

[51] Int. Cl.[5] ..... A47G 23/02

[52] U.S. Cl. ..... 248/146; 222/108; 141/87; 141/311 A

[58] Field of Search ..... 248/146; 222/108; 141/86, 87, 88, 311 A

[56] References Cited

U.S. PATENT DOCUMENTS

| | | | |
|---|---|---|---|
| 145,653 | 12/1873 | Hitchcock | 222/108 |
| 165,399 | 7/1875 | Wyckoff | 222/108 X |
| 182,749 | 10/1876 | De Yonge | 222/108 |
| 237,404 | 2/1881 | McKeever | 222/108 |
| 735,295 | 8/1903 | Price . | |
| 745,571 | 5/1905 | Cole | 222/108 X |
| 778,012 | 12/1906 | Gnover | 222/108 X |
| 1,017,756 | 2/1912 | Head . | |
| 1,121,456 | 12/1914 | Becker . | |
| 1,256,206 | 2/1918 | Cordley | 222/108 |
| 1,521,212 | 12/1924 | Allen . | |
| 1,844,709 | 2/1932 | Williams | 222/108 |
| 2,209,057 | 7/1940 | Jackson | 222/108 X |
| 2,575,920 | 11/1951 | Kilpatrick et al. . | |
| 2,834,516 | 5/1958 | Mosher | 222/108 |
| 3,353,615 | 11/1967 | Nekimken . | |
| 4,173,295 | 11/1979 | Steinman . | |

*Primary Examiner*—Ramon O. Ramirez
*Assistant Examiner*—Korie Chan
*Attorney, Agent, or Firm*—Samuelson & Jacob

[57] ABSTRACT

A dispensing stand for supporting an industrial drum in a dispensing attitude, the industrial drum having a dispensing device for dispensing selected volumes of contents poured from the industrial drum along a dispensing path to a receptacle placed at a dispensing location beneath the dispensing device, when the industrial drum is in the dispensing attitude, the dispensing stand including a housing, a cradle on the housing for supporting the industrial drum in the dispensing attitude, a reservoir in the housing, a catch basin mounted on the housing for selective movement between a first position wherein the catch basin intercepts the dispensing path for catching contents dripped from the dispensing device along the dispensing path, and a second position wherein the catch basin is clear of the dispensing path for enabling the poured contents to reach the receptacle at the dispensing location, and a drain arrangement between the catch basin and the reservoir for directing the dripped contents from the catch basin to the reservoir.

10 Claims, 2 Drawing Sheets

INDUSTRIAL DRUM DISPENSING STAND WITH DRIP CATCH BASIN

The present invention relates generally to the dispensing of the contents of industrial drums and pertains, more specifically, to a dispensing stand for industrial drums, the dispensing stand having a catch basin for catching dripped contents and capturing the dripped contents within the stand.

The current increased emphasis on environmental protection and on safety in the workplace has led to the development of a wide variety of devices and procedures for controlling the handling of potentially hazardous substances so as to avoid contamination and injury to the environment and to workers who handle such substances. In the dispensing of the contents of an industrial drum, it is common .to place the drum in a horizontal attitude, usually on a dispensing stand, and provide the drum with a spigot for dispensing selected volumes of the contents of the drum to a receptacle placed beneath the spigot. Upon removal of the receptacle, very often some of the contents will drip from the spigot and fall to the floor, or to an open basin placed beneath the spigot in place of the receptacle. Where the contents of the drum constitute a potentially hazardous substance, the presence of dripped material on the floor or in an open basin presents a potential hazard and may require relatively costly environmental clean-up procedures.

The present invention collects dripped contents emanating from the spigot of an industrial drum and captures the dripped material in an essentially enclosed reservoir for safe collection and removal. As such, the present invention exhibits several objects and advantages, some of which are summarized as follows: Provides for the safe collection and removal of potentially hazardous materials ordinarily dripped from an industrial drum dispensing arrangement; facilitates the placement and retention of an industrial drum in a dispensing attitude while accommodating contents dripped from the dispensing device of the drum; enables the practical manual dispensing of the contents of an industrial drum in selected volumes into open receptacles placed beneath a spigot located in the drum, without the danger of uncontrolled dripped material which otherwise could become a hazard to both the environment and to workers in the vicinity of the drum; essentially eliminates the necessity for relatively costly environmental clean-up procedures; provides a simplified construction for an industrial drum dispensing stand, enabling widespread economical use for increased environmental safety at reduced cost.

The above objects and advantages, as well as further objects and advantages, are attained by the present invention which may be described briefly as a dispensing stand for supporting a industrial drum in a dispensing attitude, the industrial drum having a dispensing device for dispensing selected volumes of contents poured from the industrial drum along a dispensing path to a receptacle placed at a dispensing location beneath the dispensing device, when the industrial drum is in the dispensing attitude, the dispensing stand comprising: a housing; a cradle on the housing for supporting the industrial drum in the dispensing attitude; a reservoir in the housing; a catch basin; mounting means mounting the catch basin on the housing for selective movement between a first position wherein the catch basin intercepts the dispensing path for catching contents dripped from the dispensing device along the dispensing path, and a second position wherein the catch basin is clear of the dispensing path for enabling the poured contents to reach the receptacle at the dispensing location; and drain means between the catch basin and the reservoir for directing the dripped contents from the catch basin to the reservoir.

The invention will be understood more fully, while still further objects and advantages will become apparent, in the following detailed description of a preferred embodiment of the invention illustrated in the accompanying drawing, in which.

Figure 1:
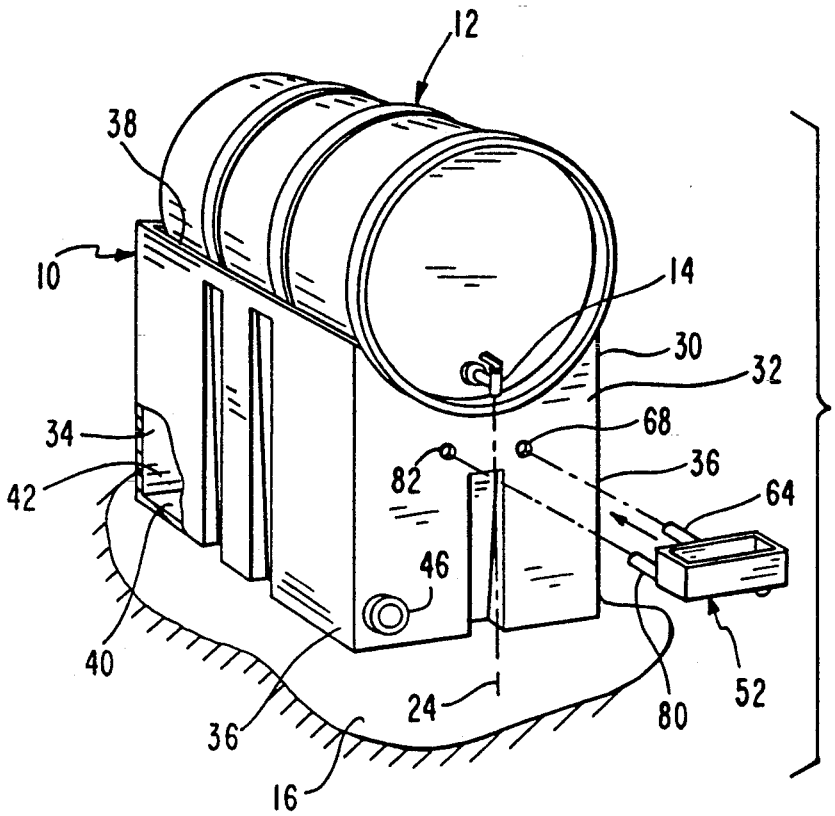
FIG. 1 is an exploded perspective view of an industrial drum dispensing stand constructed in accordance with the present invention.
Figure 5:
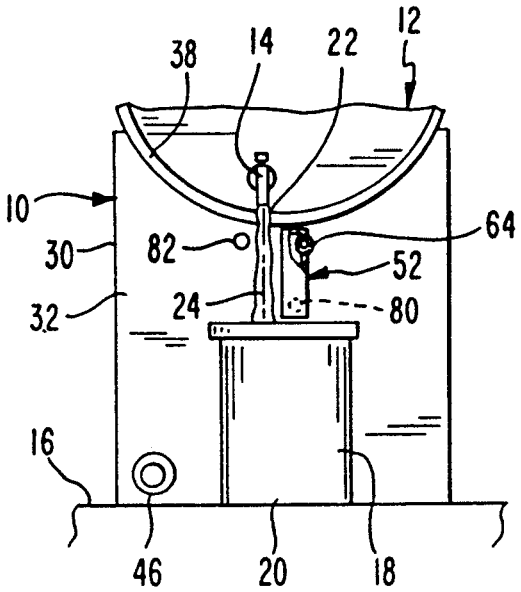
FIG. 5 is front elevational view of the dispensing stand in a dispensing mode.

Referring now to the drawing, and especially to FIG. 1 thereof, a dispensing stand 10, constructed in accordance with the present invention, is seen supporting an industrial drum 12 in a dispensing attitude wherein the industrial drum 12 is oriented horizontally and a dispensing device in the form of a spigot 14 is in place for operation to dispense selected volumes of the contents of the drum 12, usually along a dispensing path to a receptacle placed at a dispensing location on the floor 16 beneath the spigot 14, as illustrated in FIG. 5, wherein a receptacle 18 is seen placed at dispensing location 20 for the reception of contents 22 poured from the drum 12 along a dispensing path 24.

Dispensing stand 10 includes a housing 30 having a front wall 32, a rear wall 34 and opposite side walls 36. A cradle 38 is provided by the housing 30 at the top of the dispensing stand 10 and extends forward of an upward extension 39 of rear wall 34 (see FIG. 2) for supporting the industrial drum 12 in the dispensing attitude, as shown. A bottom wall 40 is integral with the front wall 32, the rear wall 34 and the side walls 36 to establish a reservoir 42 within the housing 30, and the reservoir 42 is essentially fully enclosed by the front, rear and side walls 32, 36 and 38 of the housing 30, and by a top wall 44 of semi-cylindrical configuration and generally complimentary to the corresponding configuration of the industrial drum 12, best seen in FIG. 2. A selectively removable drain plug 46 is provided in the front wall 32, for purposes which will be described in detail below.

Figure 2:
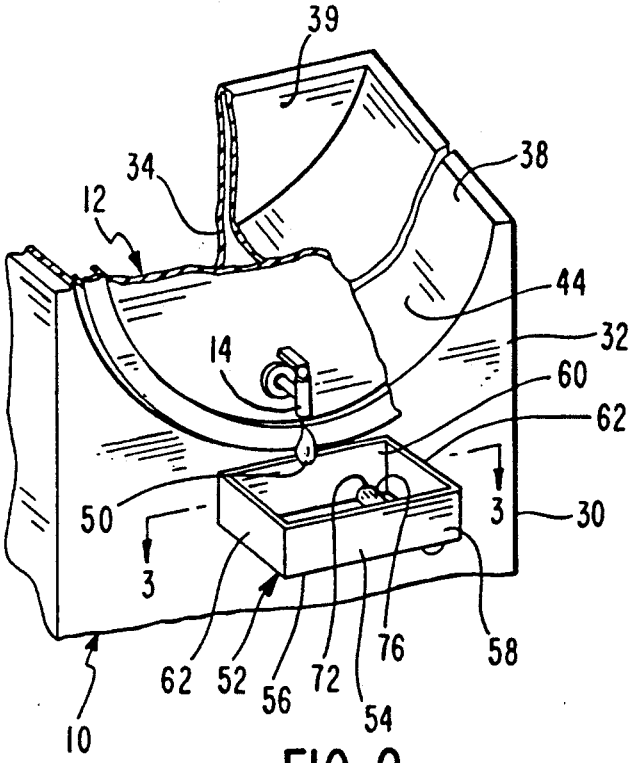
FIG. 2 is an enlarged fragmentary perspective view of a portion of the dispensing stand of FIG. 1.
Figure 3:
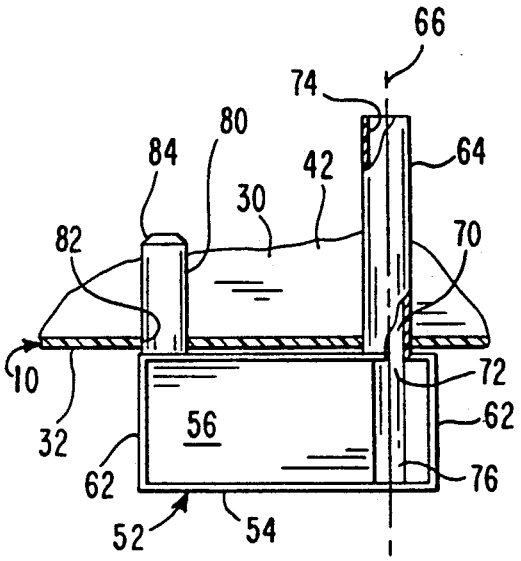
FIG. 3 is a further enlarged cross-sectional view taken along line 3—3 of FIG. 2.

Turning now to FIG. 2, as well as to FIG. 1, any tendency for the contents of the drum 12 to drip from the spigot 14, as illustrated at 50, especially immediately after operation of the spigot 14 to pour a selected volume of the contents into a receptacle, presents a potential for the accumulation of dripped material on the floor 16. Such an accumulation on the floor 16 can constitute a hazard in the workplace, both to the environment and to workers in the vicinity of the drum 12, especially where the contents of the drum 12 comprise a hazardous material. In order to control the dripped contents, a catch basin 52 is coupled with the housing 30 for location in the dispensing path 24 so as to intercept the dripped contents 50. Thus, catch basin 52 includes a drip tray 54 having a bottom wall 56, a front wall 58, a rear wall 60 and opposite side walls 62. Mounting means mount the catch basin 52 on the housing 30 and include a mounting member in the form of a tubular member 64, integral with the catch basin 52 along the bottom wall 56 and extending along a longitudinal axis 66 to engage a complementary opening 68 in the front wall of the housing 30. As best seen in FIG. 3, tubular member 64 includes an internal passage 70 which communicates with the interior of the catch basin 52, through an entrance opening 72 in the rear wall 60 of the drip tray 54, and communicates with the reservoir 42 through an exit at 74. A trough 76 in the bottom wall 56 of the catch basin 52 assists in draining the dripped contents from the interior of the catch basin 52 to the internal passage 70 of the tubular member 64.

Figure 4:
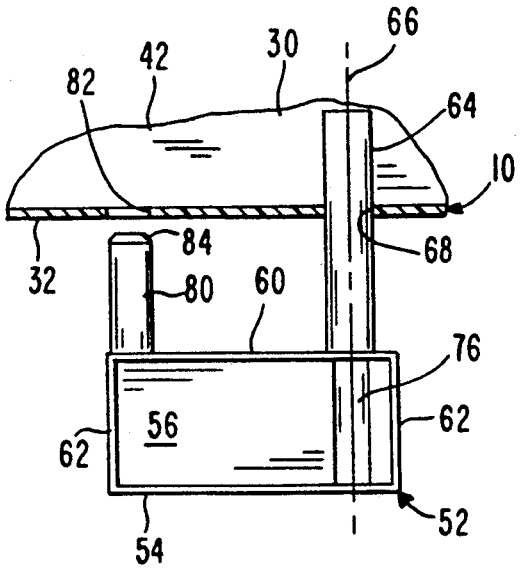
FIG. 4 is a view similar to FIG. 3, but with the component parts in another operating position.

Tubular member 64 is journaled within opening 68 for pivotal movement about longitudinal axis 66 between a first position wherein the catch basin 52 intercepts the dispensing path 24, as illustrated in FIG. 2, and a second position wherein the catch basin 52 is clear of the dispensing path 24, as illustrated in FIG. 5, for the selective dispensing of contents from the drum 12 to the receptacle 18. In addition, tubular member 64 is received in opening 68 for sliding movement in longitudinal directions along the longitudinal axis 66. Catch basin 52 is locked in place in the first position by locking means including a locking member in the form of a rod 80 integral with the rear wall 60 of the drip tray 54 of catch basin 52 and extending longitudinally essentially parallel to the tubular member 64. When the catch basin 52 is in the first position, as illustrated in FIG. 3, rod 80 is received within a complementary recess 82 in the front wall 32 of the housing 30 and the catch basin 52 is secured in place in the first position. When it is desired to dispense a selected volume of contents from the drum 12, catch basin 52 is pulled in the longitudinal direction away from the front wall 32 of the housing 30 to displace the catch basin 52 forward until rod 80 is withdrawn from recess 82, as shown in FIG. 4. However, tubular member 64 has a longitudinal length greater than the longitudinal length of rod 80, and tubular member 64 remains journaled within opening 68. Catch basin 52 then is pivoted about longitudinal axis 66, by virtue of the journaled engagement of tubular member 64 within opening 68, until the catch basin 52 is placed in the second position, clear of the dispensing path 22, as shown in FIG. 5. Upon completion of the dispensing of a selected volume of the contents of the drum 12 into the receptacle 18, the catch basin 52 merely is pivoted back to the orientation illustrated in FIG. 4, and then is pushed to displace the catch basin 52 rearward until the rod 80 enters the recess 82, as shown in FIG. 3, and the catch basin 52 is placed in the first position illustrated in FIG. 2, wherein the catch basin 52 is in position to intercept contents subsequently dripped from the spigot 14. Rod 80 includes a tapered tip 84 to facilitate the entry of rod 80 into recess 82.

The dripped contents intercepted by the catch basin 52 are drained from the drip tray 54 of the catch basin 52, through internal passage 70, to the reservoir 42 in the housing 30. Since the reservoir 42 is essentially fully enclosed by the housing 30, collection of the dripped contents in the reservoir 42 provides control over the dripped contents and essentially eliminates the danger of uncontrolled accumulations of the dripped contents on the floor 16 of the workplace. Upon the collection of a sufficient volume of dripped contents within the reservoir 42, dispensing stand 10 merely is moved to a disposal location, which ordinarily is remote from the workplace, the drain plug 46 is removed, and the collected volume is drained from the reservoir 42 for proper disposal.

In the preferred construction, housing 30 is molded of a synthetic polymeric material, preferably by rotational molding in a unitary construction. Catch basin 52 also preferably is molded of a synthetic polymeric material, with tubular member 64 and rod 80 molded unitary with drip tray 54. The molded construction enables the economical manufacture of the complete dispensing stand 10 and promotes widespread use at reduced cost.

It will be seen that the present invention attains the several objects and advantages summarized above; namely: Provides for the safe collection and removal of potentially hazardous materials ordinarily dripped from an industrial drum dispensing arrangement; facilitates the placement and retention of an industrial drum in a dispensing attitude while accommodating contents dripped from the dispensing device of the drum; enables the practical manual dispensing of the contents of an industrial drum in selected volumes into open receptacles placed beneath a spigot located in the drum, without the danger of uncontrolled dripped material which otherwise could become a hazard to both the environment and to workers in the vicinity of the drum; essentially eliminates the necessity for relatively costly environmental clean-up procedures; provides a simplified construction for an industrial drum dispensing stand, enabling widespread economical use for increased environmental safety at reduced cost.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A dispensing stand for supporting an industrial drum in a generally horizontal dispensing attitude at a dispensing site, the industrial drum having opposite ends and a dispensing device at one of the opposite ends for dispensing selected volumes of contents poured from the industrial drum along a generally vertical dispensing path to a receptacle placed at a dispensing location beneath the dispensing device, when the industrial drum is in the generally horizontal dispensing attitude at the dispensing site, the dispensing stand comprising:

a housing, the housing including a front wall, a rear wall, opposite side walls, a top wall and a bottom wall;

a cradle on the housing, the cradle including a semicylindrical portion extending along the top wall, from one of said opposite side walls to the other one of said opposite side walls and from the rear wall to the front wall, for supporting the industrial drum in the generally horizontal dispensing attitude, with the one of the opposite ends overlying the dispensing location so as to locate the dispensing device adjacent the front wall and above the dispensing location;

a reservoir in the housing, the reservoir being established and fully enclosed by the front wall, the rear wall, the opposite side walls, the top wall and the bottom wall of the housing;

a catch basin;

mounting means mounting the catch basin on the front wall of the housing for selective movement between a first position where the catch basin intercepts the dispensing path for catching contents dripped from the dispensing device along the dispensing path, and a second position wherein the catch basin is clear of the dispensing path for enabling the poured contents to reach the receptacle at the dispensing location; and drain means between the catch basin and the reservoir for directing the dripped contents from the catch basin to the reservoir wherein the dripped contents are essentially fully enclosed for isolation from the dispensing site and for confinement during movement of the housing, and the reservoir, from the dispensing site to a disposal site.

2. The invention of claim 1 wherein the mounting means includes a mounting member coupling the catch basin and the housing for pivotal movement of the catch basin between the first position and the second position.

3. The invention of claim 2 wherein the mounting member is integral with the catch basin and is journaled in the housing.

4. The invention of claim 3 wherein the mounting member comprises a tubular member having an internal passage communicating with the catch basin and the reservoir.

5. The invention of claim 4 including locking means for locking the catch basin in the first position.

6. A dispensing stand for supporting an industrial drum in a dispensing attitude, the industrial drum having a dispensing device for dispensing selected volumes of contents poured from the industrial drum along a dispensing path to a receptacle placed at a dispensing location beneath the dispensing device, when the industrial drum is in the dispensing attitude, the dispensing stand comprising:

a housing;

a cradle on the housing for supporting the industrial drum in the dispensing attitude;

a reservoir in the housing;

a catch basin;

mounting means mounting the catch basin on the housing for selective movement between a first position where the catch basin intercepts the dispensing path for catching contents dripped from the dispensing device along the dispensing path, and a second position wherein the catch basin is clear of the dispensing path for enabling the poured contents to reach the receptacle at the dispensing location, the mounting means including a mounting member coupling the catch basin and the housing for pivotal movement of the catch basin between the first position and the second position, the mounting member being integral with the catch basin and journaled in the housing, the mounting member comprising a tubular member having an internal passage communicating with the catch basin and the reservoir;

locking means for locking the catch basin in the first position; and drain means between the catch basin and the reservoir for directing the dripped contents from the catch basin to the reservoir, the drain means including the internal passage in the tubular member;

the tubular member including a longitudinal axis and being mounted within the housing for pivotal movement about the longitudinal axis and for sliding movement in longitudinal directions along the longitudinal axis, toward and away from the housing; and the locking means including a rod extending generally parallel to the tubular member and coupling means responsive to displacement of the catch basin and the tubular member in the longitudinal directions for coupling the rod, the catch basin and the housing when the catch basin is in the first position, and for uncoupling the rod, the catch basin and the housing to enable pivotal movement of the catch basin from the first position to the second position.

7. The invention of claim 6 wherein the rod is integral with the catch basin, and the housing includes a recess complementary to the rod and so located in the housing that upon movement of the catch basin in a longitudinal direction toward the housing, the rod will engage the recess to secure the catch basin in the first position, and upon movement of the catch basin in a longitudinal direction away from the housing, the rod will be disengaged from the recess for permitting pivotal movement of the catch basin to the second position.

8. The invention of claim 7 wherein the tubular member has a first longitudinal length and the rod has a second longitudinal length less than the first longitudinal length such that upon displacement of the catch basin in the longitudinal direction away from the housing and disengagement of the rod from the recess, the tubular member remains journaled in the housing for pivotal movement of the catch basin between the first and second positions.

9. The invention of claim 1 wherein the housing is constructed of a synthetic polymeric material.

10. The invention of claim 9 wherein the housing is a unitary molded construction.

* * * * *